US007178931B1

(12) United States Patent
Murphy

(10) Patent No.: US 7,178,931 B1
(45) Date of Patent: Feb. 20, 2007

(54) MASK ILLUMINATION DEVICE AND PERSONNEL LOCATOR AND/OR COMMUNICATOR

(75) Inventor: Gary E. Murphy, Hamden, CT (US)

(73) Assignee: Trispec Eye Gear, Hamden, CT (US)

( * ) Notice: Subject to any disclaimer, the term of this patent is extended or adjusted under 35 U.S.C. 154(b) by 0 days.

(21) Appl. No.: 11/267,124

(22) Filed: Nov. 4, 2005

(51) Int. Cl.
*F21V 21/84* (2006.01)

(52) U.S. Cl. ..... 362/105; 362/84; 2/410

(58) Field of Classification Search ..... 362/103, 362/105, 106, 84, 208; 2/410, 422, 424, 2/427, 906
See application file for complete search history.

(56) References Cited

U.S. PATENT DOCUMENTS 4,283,798 A * 8/1981 Kuehn ..... 2/426
5,003,973 A * 4/1991 Ford et al. ..... 128/201.25
5,033,818 A * 7/1991 Barr ..... 359/630
5,034,747 A * 7/1991 Donahue ..... 342/20
5,402,188 A * 3/1995 Wayne ..... 351/43
5,408,393 A * 4/1995 Becker ..... 362/105
5,525,989 A * 6/1996 Holt ..... 342/20
6,113,243 A * 9/2000 Saul ..... 362/105
6,416,199 B1 * 7/2002 Heine ..... 362/105
2004/0012979 A1 * 1/2004 Squicciarini ..... 362/555
2004/0042200 A1 * 3/2004 Hurwitz ..... 362/84

* cited by examiner

*Primary Examiner*—Renee Luebke
*Assistant Examiner*—Gunyoung T. Lee
(74) *Attorney, Agent, or Firm*—McCarter & English, LLP

(57) ABSTRACT

A mask illumination device and method. The device includes a mask having a face shield, a portion of which is visible therethrough, and configured to substantially isolate fluid communication of an external environment from an interior of the mask when worn by the user. The mask also includes an illumination apparatus disposed within the interior of the mask. The illumination apparatus is configured to illuminate the face of the user, project light outward of the mask, or illuminate or beacon a user from a distance. The method includes substantially isolating fluid communication of an external environment from an interior environment with a mask worn by a user, the mask having a face shield, a portion of which is visible therethrough. The method also includes disposing an illumination apparatus within the interior of the mask, the illumination apparatus configured to project light outward of the mask.

19 Claims, 8 Drawing Sheets

MASK ILLUMINATION DEVICE AND PERSONNEL LOCATOR AND/OR COMMUNICATOR

BACKGROUND OF THE INVENTION

1. Field of the Invention

This invention is concerned with a method and/or apparatus for illumination and/or lighting inside of a face mask. In particular, electroluminescent or other technologies of illumination of the interior of a mask or helmet optionally as accompanied with a breathing apparatus. A particular application is directed to illumination of the face of a person wearing a full face mask as typically used for, but not limited to: fire-fighting, military/government, e.g., fighter pilots operations, law enforcement, industrial applications, such as mining, chemical applications, emergency first responders, defense/security, domestic preparedness, Haz-Mat, theatrical applications, etc. Typical products employed in such applications include, but are not limited to a: respirator, Self Contained Breathing Apparatus (SCBA), Self Contained Underwater Breathing Apparatus (SCUBA), dive masks, Powered Air Purifying Respirator (PAPR), Closed Circuit Breathing Apparatus (CCBA), Air Purifying Respirator, Supplied Air Respirator, and the like.

2. Description of the Related Art

With the increased world-wide threat of terrorism along with the already dangerous occupations in fire, military, law enforcement and industry (though many advances have been made), the need for more effective, innovative products to help in visual communicating and navigating these certain individuals through life and death missions with little or no visibility are of great importance to both preserving and saving lives.

There are numerous systems employing illuminating technologies for applications with safety helmets and the like. Visual Defense of North Carolina produces personal safety lighting utilizing electroluminescent light wire technology notably a light band that can be secured around the outside of a safety hardhat, safety helmet, firefighter's helmet, etc., that is energized by means of a battery pack.

Similarly, U.S. Pat. No. 5,664,128 to Richardson describes a safety helmet which when worn by a user allows for locating and visual identification of the wearer in a hostile environment. In particular, the patent is directed to a safety helmet which provides for an electroluminescent strip member conformed and attached to a face shield or crown of a safety helmet. More particularly, the patent relates to a portable system which is incorporated within a safety helmet to allow the wearer complete flexibility in his or her movements. Richardson also describes a system whereby an electrical actuating circuit may be coupled to a personal alert safety system to provide a blinking of the electroluminescent lamp strip member when no motion is detected from the user over some predetermined time. Still further, the electroluminescent member may be actuated to emit different and particular colors, the safety helmet may then be used for identification of a user or group of users in a hostile environment.

United States Patent Application Ser. No. 2005/0047116 to Gagne describes an auxiliary light source for a self-contained breathing mask. The auxiliary light source includes a plurality of illuminable light-emitting sources and a plurality of opaque reflectors. A plurality of substantially rectangular transparent lenses are positioned over the light-emitting sources. Each lens includes a plurality of integrally disposed finger portions defining mounting brackets engageable with the mask support rim. The device further includes a central panel secured to the mask support rim by a fastening member and a plurality of flexible rubber seals sandwiched between the panel and the lenses respectively. A control switch and a power supply source are electrically coupled thereto and to the light-emitting sources respectively.

While the abovementioned products provide significant advantages for the detection and identification of a user, particularly leveraging the advantages of an electroluminescent member such configurations subject the electroluminescent member to hostile environments that may compromise its effectiveness with dirt, grime, and the like. In fact, some manufacturers include disclaimers stating the product is not fireproof, flameproof or flame retardant and any part may be damaged in ambient temperatures above 200° F. Furthermore, placement of the light source, e.g., an electroluminescent member, on the face shield or crown of the safety helmet subjects the electroluminescent member to potential damage from external debris, fire, hazardous materials or even when the safety helmet is removed and placed on a table or shelf. What is needed in the art is a safety helmet and/or self contained breathing apparatus/mask that includes illumination provided within the safety helmet and/or mask to ensure that a user's face is illuminated to facilitate identification and facial expressions (communication) while simultaneously providing a hands free task illumination to aid the user. Furthermore, what is needed in the art is an illumination apparatus and method that mitigates or eliminates the abovementioned detrimental effects of a hostile environment on any illumination apparatus.

BRIEF SUMMARY OF THE INVENTION

Disclosed herein in an exemplary embodiment is a mask illumination device. The device includes a mask having a face shield, a portion of which is visible therethrough, and configured to substantially isolate fluid communication of an external environment from an interior of the mask when worn by the user. The mask also includes an illumination apparatus disposed within the interior of the mask. The illumination apparatus is configured to illuminate the face of the user, project light outward of the mask, or illuminate or beacon a user from a distance.

Also disclosed herein in another exemplary embodiment is a method of hands free illumination. The method includes substantially isolating fluid communication of an external environment from an interior environment with a mask worn by a user, the mask having a face shield, a portion of which is visible therethrough. The method also includes disposing an illumination apparatus within the interior of the mask, the illumination apparatus configured to project light outward of the mask.

Further disclosed herein in another exemplary embodiment is a method of identifying personnel. The method includes substantially isolating fluid communication of an external environment from an interior environment with a mask worn by a user, the mask having a face shield, a portion of which is visible therethrough. The method also includes disposing an illumination apparatus within the interior of the mask, the illumination apparatus configured to illuminate the face of the user.

Also disclosed herein in yet another exemplary embodiment is a method of a personnel beaconing or signaling. The method includes substantially isolating fluid communication of an external environment from an interior environment with a mask worn by a user, the mask having a face shield, a portion of which is visible therethrough. The method further includes disposing an illumination apparatus within the interior of the mask, the illumination apparatus configured project light internally or outward of the mask and thereby be seen by another.

In another exemplary embodiment, disclosed herein is a system for hands free illumination. The system includes means for substantially isolating fluid communication of an external environment from an interior environment with a mask worn by a user, the mask having a face shield, a portion of which is visible therethrough. The system also includes means for disposing an illumination apparatus within the interior of the mask, the illumination apparatus configured to project light internally or outward of the mask.

Further in yet another embodiment, disclosed herein is a mask illumination device. The device includes a mask having a face shield a portion of which is visible therethrough; and an illumination apparatus disposed within the interior of a mask, the illumination apparatus configured to at least one of, (i) illuminate the face of the user, (ii) project light outward of the mask, or (iii) illuminate or beacon a user from a distance. The device also includes a support structure attachable to the interior of the mask configured to support the illumination apparatus substantially about the periphery of the face shield of the mask.

Additional features, functions, and advantages associated with the disclosed methodology will be apparent from the detailed description which follows, particularly when reviewed in conjunction with the figures appended hereto.

BRIEF DESCRIPTION OF THE DRAWINGS

To assist those of ordinary skill in the art in making and using the disclosed embodiments, reference is made to the appended figures, wherein like references are generally numbered alike in the several figures.

DETAILED DESCRIPTION OF THE EXEMPLARY EMBODIMENTS

Figure 1:
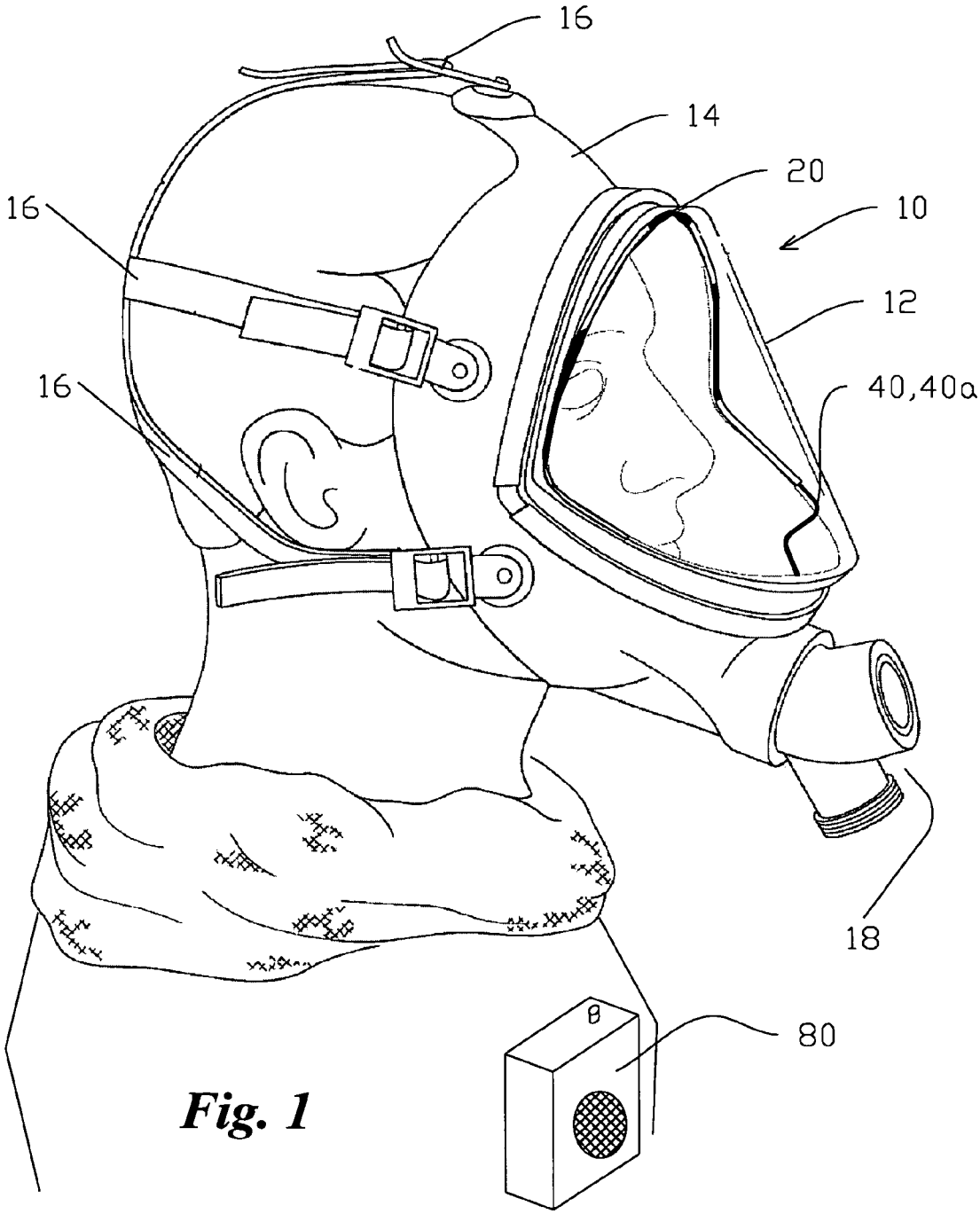
FIG. 1 depicts a side view of a full face mask as may be employed with a self contained breathing apparatus or respirator worn by a user with illumination system in accordance with an exemplary embodiment.

Disclosed herein in one or more exemplary embodiments is a method and/or apparatus for locating and visual identification of the wearer, particularly in a hostile environment. In particular, an apparatus for providing illumination and/or lighting inside of a face mask and/or safety helmet and/or including a face mask. In an exemplary embodiment, electroluminescent, or other technologies of illumination are employed on the interior of a mask or helmet, optionally as accompanied with a self contained breathing apparatus. A particular application electroluminescent, or other technologies of illumination are employed on the interior of a mask or helmet, optionally as accompanied with a self contained breathing apparatus. A particular application is directed to illumination of the face of a person wearing a full face mask as typically used for, but not limited to: fire-fighting, military/government operations, law enforcement, industrial applications, emergency first responders, defense/security, domestic preparedness, Haz-Mat, mining, theatrical applications, diving, and the like. Products employed in such applications include, but are not limited to, a respirator, Self Contained Breathing Apparatus (SCBA), Self Contained Underwater Breathing Apparatus (SCUBA), Powered Air Purifying Respirator (PAPR), Closed Circuit Breathing Apparatus (CCBA), Air Purifying Respirator, Supplied Air Respirator, and the like as well as combinations including any of the foregoing.

An advantage of the exemplary embodiments is to enhance the ability to communicate with or locate a working or immobilized firefighter, particularly in smoke, dust, fog, or complete darkness and to illuminate a user's facial expressions, particularly in critical life threatening situations. Yet another advantage one or more of the disclosed embodiments is to project light outside of a mask for hands free illumination of doorknobs, tools, hoses, reflective striping on turn out gear and safety clothing and the like.

In another exemplary embodiment of the invention the apparatus is directed to a safety helmet/mask configured to provide ambient lighting (and increased ambient lighting area with each additional user in close proximity) to aid the user(s) in observations without diminishing the eye's natural (scotopic) night vision capabilities.

Another embodiment of this invention relates to a portable system which is incorporated with a safety helmet and/or mask to allow the wearer complete flexibility in his or her movements. Still further, this invention relates to a safety helmet and/or mask and illumination system which incorporates an electroluminescent wire or other technology electrically coupled to an electrical actuating circuit preferably releasably mounted in/on the internal contour of the mask. Still further, this invention directs itself to a mask and illumination system whereby the electrical actuating circuit is preferably releasably coupled to the mask or a safety helmet. Further, this invention relates to a system whereby the electrical actuating circuit may be coupled to a personal alert safety system to provide a blinking of the electroluminescent member when no motion is detected from the user over some predetermined time. Still further, due to the fact that the electroluminescent lamp strip member may be actuated to emit different and particular colors, the safety helmet and/or mask may be used for identification of the wearer or coupled with a heads up display indicating air supply levels etc. in a hostile environment.

It will be appreciated that the embodiments disclosed, while described and illustrated with reference to a safety helmet and/or breathing masks as customarily employed by firefighters, should not be considered as limited thereto. It should be understood that the embodiments disclosed herein may readily be used to provide light to many different types of masks, escape hoods, helmets, and the like, as well as combinations including at least one of the foregoing and a variety of users and applications.

It is to be understood that mask 10 may be used in a wide variety of manners for indicating the presence of a person in a particular environment, identification of a person, personnel beaconing or and signaling of a warning or call for help. These aspects are significant in conditions where the lighting conditions are of a nature which do not allow efficient visual assessment and in areas where the external environment is of a nature which does not provide for the visual acuity necessary to provide an adequate visual survey of the conditions in the environment. Due to the extreme environments, it has become important that personnel working in teams be able to note the presence of other personnel in the area and to allow for a signaling in the event that a user is immobilized or otherwise unable to further function.

Figure 2:
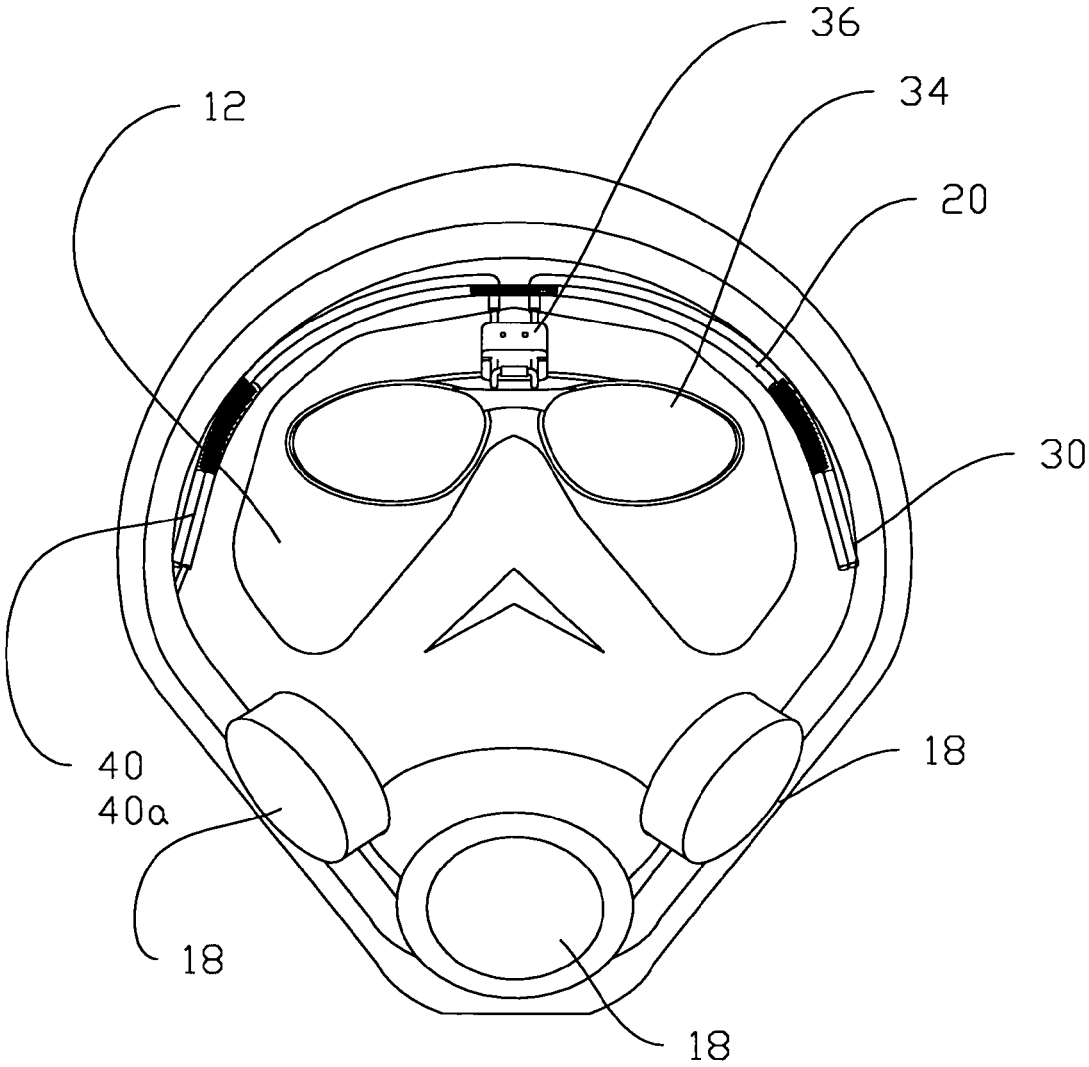
FIG. 2 depicts a front view of a full face mask as may be employed with a self contained breathing apparatus or respirator with illumination system and spectacle support in accordance with an exemplary embodiment.

Referring now to FIGS. 1 and 2, there is shown a full face mask 10 as may be employed with a self contained breathing apparatus with illumination system 20 integral therewith. In this example, a full face mask 10 is depicted and has particular adaptability for use by firemen, emergency personnel, and the like, in areas where the fireman's visual acuity is lowered due to an environment which has a high degree of smoke and other contaminants which impedes the user's ability to breath and to visually assess the situation. The full face mask 10 may readily be worn with a safety helmet (not shown) to provide impact protection to the wearer. In fact, the full face mask 10 may also be readily integrated with a safety helmet as desired.

The mask 10 preferably includes a face shield 12, clear or tinted, and optionally sealing member 14. The mask 10 is configured to seal to the face of the user sufficiently to substantially isolate the environment of the interior of the mask 10 from the external environment when worn. The mask preferably further includes straps 16 or other means for securing the mask to the face of the user and to facilitate the aforementioned sealing. The mask 10 may further include an inlet/outlet to permit connection of breathing apparatus 18, air hose, snorkel, respirator, filter, and the like.

In order to permit optimum movement of the wearer, the mask 10 is preferably easily portable with the illumination system 20 mounted internal of the face shield 12 protected from the exterior environment in a manner such that operation may be provided over an extended period of time. Isolating the illumination system 20 from the external environment and placement of the illumination system 20 internal to the mask 10 advantageously casts illumination on the face of the user, while also projecting illumination outward to facilitate operational tasks, identification, and rescue. Furthermore, placement of the illumination system 20 on the interior of the mask 10 reduces the potential for damage or loss during mishaps and remains clean to provide uninterrupted and peak performance levels, a point of significance should a mishap result in a user being immobilized. Furthermore, it would be beneficial if the illumination system 20 exhibited low electrical power requirements with portability that permits the system to be mounted on the body or in close proximity thereto. Preferably the illumination system 20 is removably attached on the interior of the face shield 12 about the periphery thereof. Additionally, the illumination system 20 should exhibit a substantially low heat output generation, due to the proximity to the user, environment in which the person is working, which in itself may be toxic and have excessively high temperatures associated with the surrounding environment.

In order to achieve the desired capabilities and functionality, an exemplary embodiment of the full face mask 10 employs an illumination system 20 based on the use of electroluminescence or other low heat/energy consumption technology to provide lighting, warning or identification signals. Electroluminescence is a highly efficient method for the generation of light within the visible band width of the electromagnetic energy spectrum. In general, this is a generation of light in a non-metallic solid through the application of an electric field. Advantageously, electroluminescence is a cool light exhibiting significant brightness for the power dissipated. Furthermore, electroluminescence produces a soft uniform glow that does not emit rays and thus does not interfere with night vision. Advantageously, electroluminescent lights can be seen at all angles and in a variety of lighting conditions such as through complete darkness, smoke, dust, fog or other particles in the air, and are not obscured by ambient lights and exhibit better contrast than other forms of light in such conditions. Firefighters, for example, are commonly confronted with both smoke filled environments and significant visual impairment due to the environment.

Electroluminescence is a form of radiation resultant from a change in electrical state in a non-metallic solid. Primary electronic states of non-metallic solids generally include two bands of allowed states separated by what is termed a forbidden gap where only states due to the impure atoms or lattice imperfections exist. At normal temperatures a higher energy band which is called the conduction band is generally empty except for a small number of moving electrons. The lower energy band, commonly called the valence band is filled with electrons with the exception of vacant states which are commonly called holes. Due to the interactions with thermal vibrations, electrons in the conduction band fall to a low energy edge and holes in the valence band rise to a high energy edge. When the excess electrons and holes are produced and brought into proximity by the action of an applied electric field, the electrons will spontaneously fall into or recombine with the holes. This recombination releases energy comparable to the particular band gap and is dissipated in one form as radiation known as electroluminescence.

Continuing with FIGS. 1 and 2, mask 10 may be a standard mask protecting at least the eyes or face mask covering the mouth and nose as well to include breathing. The mask 10 also includes a support structure 30 for the illumination system 20. The support structure 30 is removably secured to the mask 10, in one embodiment as shown, about the upper perimeter of the face shield 12. The illumination system 20 of an exemplary embodiment includes various means of illumination, including, but not limited to, an electroluminescent member, incandescents such as light bulbs, light emitting diodes, and the like, and any other lighting technology currently known or developed hereafter, as well as combinations including at least one of the forgoing. The illumination system 20 of one exemplary embodiment includes an electroluminescent member 40 supported by the support structure 30. Further, in one embodiment the electroluminescent member 40 is an electroluminescent strip or wire 40*a*, however, other configurations may be employed. The electroluminescent member 40, 40*a* emits electromagnetic radiation within a particular visible band width of the electromagnetic energy spectrum. The particular electroluminescent member 40, 40*a* used in the subject invention concept is well known in the art and is commercially available. As described for this implementation and the mask 10, electroluminescent wire 40*a* is produced by Elam-Electroluminescent Industries Ltd. having a business address in Jerusalem, Israel. As outlined above, electroluminescent member 40, 40*a* converts electrical energy into light for luminescence and where a DC electric field is applied to a thin phosphor, such produces light. When an AC voltage is applied, the electric field causes the phosphor to charge and discharge, resulting in a "pulsed" or "blinking" emission of light during each cycle. Since the number of light pulses depends on the voltage cycling frequency and the intensity of the pulses depends on the amount of applied voltage, the brightness of the electroluminescent member 40, 40*a* may be increased by increasing operating voltage and/or frequency.

Preferably, electroluminescent member 40 is flexible in nature and may be conformed to the inner contour of the mask 10 and particularly face shield 12 to provide isolation and protection from the abovementioned hostile environment. Additionally, electroluminescent member 40 is preferably supported by integrating into mold of mask, and/or the support structure 30. Furthermore, in another exemplary embodiment the electroluminescent member 40 and/or support structure 30, is attached by means of being molded inside the mask 10, attached with clips (not shown), or integrated with an eyewear insert 34 (e.g., optical insert, spectacle kit, and the like) via a spectacle mounting block 36 or similar type of supporting platform. In another exemplary embodiment, the support structure and/or electroluminescent member 40 may be adhesively secured through an appropriate adhesive bonding, "glow in the dark" products, reflective tapes, or luminescent shrink tubing or the like. It should be appreciated that the particular method of securement, particularly an adhesive bonding technique not important to the inventive concept as herein described with the exception that any method or compound being used for adhesive securement be compatible with the environmental conditions necessarily encountered by the user. Thus, electroluminescent member 40 may be glued or epoxied in the normal manner to the interior surface of the mask 10 or to the surface of transparent shield 12. Advantageously, it should readily be appreciated that the method and apparatus disclosed herein including placing the electroluminescent member interior to the mask 10 provides an increased level of protection not achievable with existing systems that place a light or illumination means external to the mask. Therefore, advantageously, the electroluminescent member 40 and support structure 30 whether it includes an adhesive means or not of the disclosed embodiments is protected from the most extreme environments as encountered by the user. In particular, placement of the electroluminescent member 40 on the interior of the mask 10 results in low maintenance since it is protected from the harsh environments outside the mask with such elements as heat, dirt, airborne debris or water. In contrast, existing systems with illumination members located outside the mask or on a safety helmet are subjected to the full effects of the hostile environment. The illumination member 40 may fall off or become dislodged by coming in contact with either someone or something.

Figure 3:
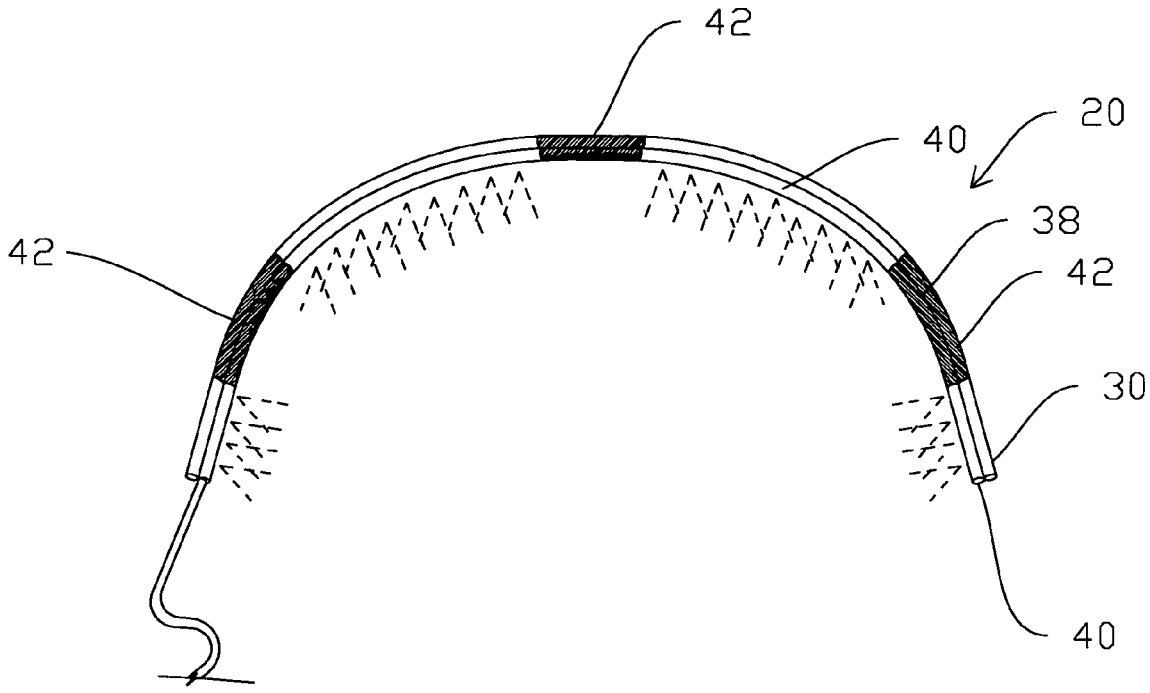
FIG. 3 depicts a view of the support structure with the electroluminescent member with darkened portions in accordance with an exemplary embodiment.
Figure 4:
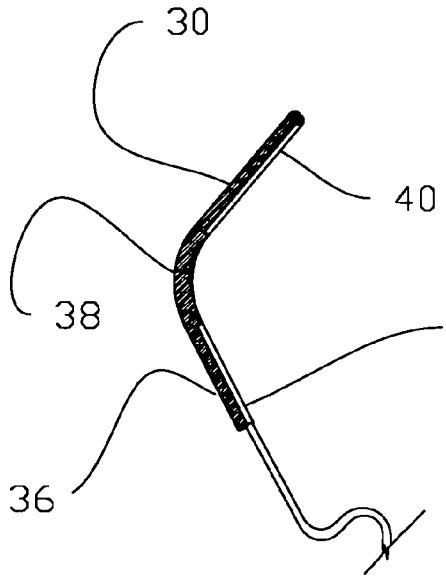
FIG. 4 depicts a partial view of the support structure with the electroluminescent member in accordance with an exemplary embodiment.
Figure 5:
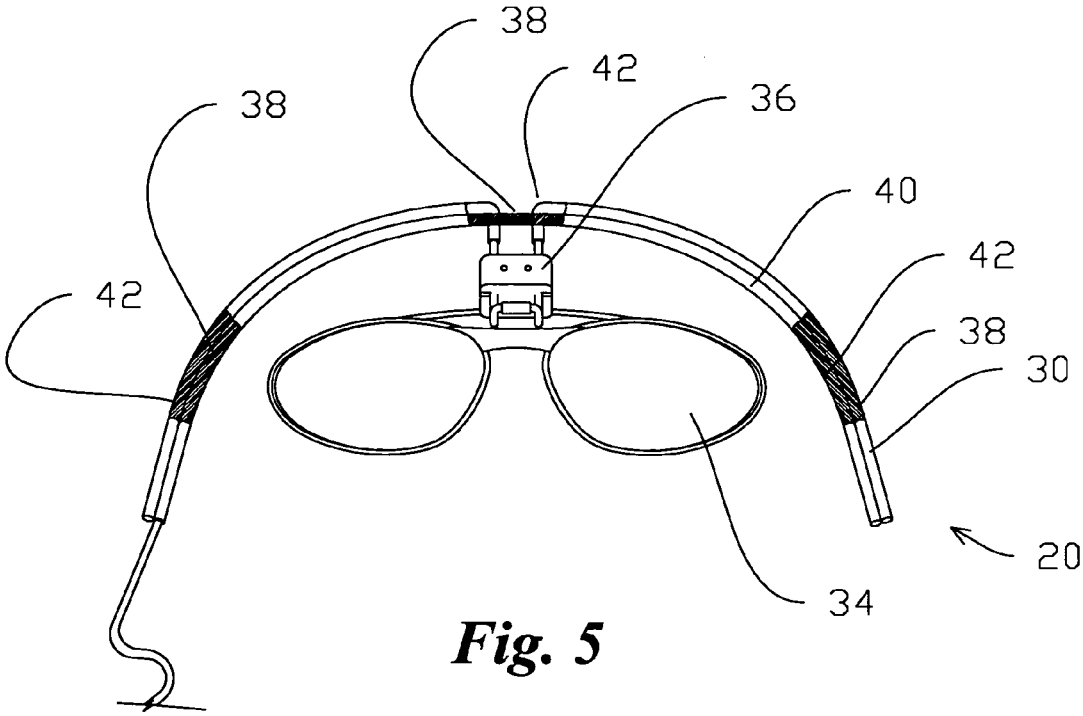
FIG. 5 depicts a spectacle kit or eyewear insert and support structure with the electroluminescent member in accordance with an exemplary embodiment.

Turning now to FIGS. 3, 4, and 5 as well, in an exemplary embodiment, the electroluminescent member 40 may readily be attached to the support structure 30 as needed to provide sufficient support. Preferably in an exemplary embodiment, the electroluminescent member 40 may include darkened, deflected or covered portions along the length thereof. The darkened portions 42 are placed to ensure that there is no direct luminescence in the vicinity of the users direct line of sight to avoid glare. Turning to FIG. 5 as well, in one exemplary embodiment, for example, that by employing an eyewear insert 34, a support wire 30 may be first cut to size then custom shaped to fit each individual mask 10. In an exemplary embodiment, the support wire 30 is preferably made of spring tempered hardened nickel silver. The support wire 30 is then deburred at both ends followed by an optional application of a chrome, black, and the like, protective finish. The support wire 30 may then be coated or insulated as needed. For example, painted or simply covered with polymer shrink tubing or the like. Polymer shrink tubing can be advantageous for its gripping properties and for supporting itself against the inside of the mask 10. The EL electroluminescent wire 40, 40*a* is then attached to the support wire as desired. In one embodiment, the electroluminescent wire 40, 40*a* is simply attached using clear and/or black, and/or photoluminescent (e.g., glow in the dark) polymer shrink tubing 38 (or similar means) over both the support wire 30 and the electroluminescent wire 40,40*b* placed at strategic points (for example to provide the darkened portions 42 outlined above).

Figure 6:
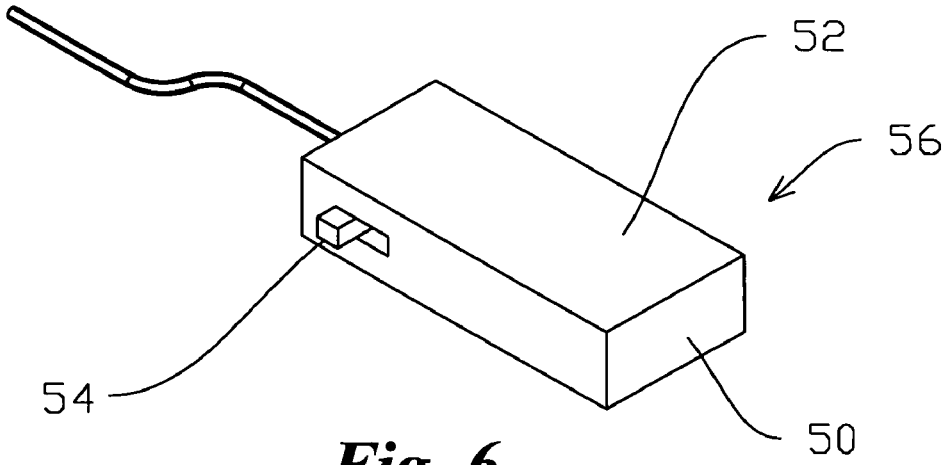
FIG. 6 depicts a control apparatus in accordance with an exemplary embodiment.
Figure 7:
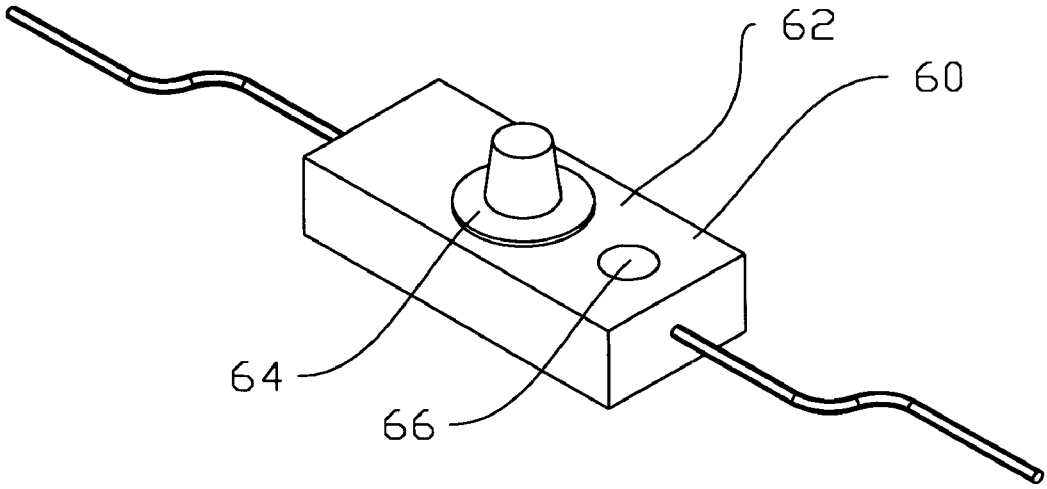
FIG. 7 depicts another control apparatus in accordance with an exemplary embodiment.
Figure 8:
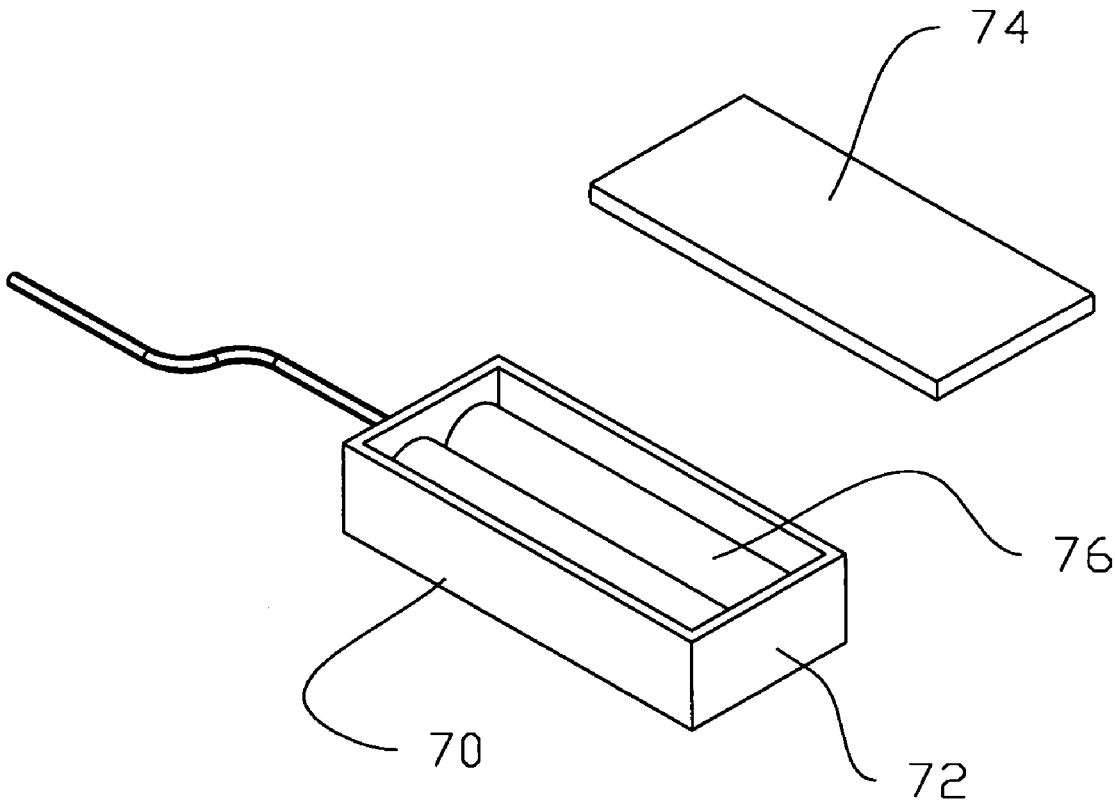
FIG. 8 depicts yet another control apparatus in accordance with an exemplary embodiment.

Turning now to FIGS. 6, 7, and 8, mask 10 and/or illumination system 20 further include a controller 50 to electrically actuate electroluminescent member 40. Controller 50 is preferably removably mounted to mask 10 and electrically coupled to the electroluminescent member 40. In one embodiment, controller 50 includes a housing 52 containing an electrical actuation switch 54 configured to supply or interrupt power supplied to the electroluminescent member 40. Controller 50 in another embodiment may further include an energizing circuit shown generally as reference numeral 56 which may include, but not be limited to, a transformer, inverter, or timer for converting a DC signal to an AC signal for input to electroluminescent member 40, in one instance, for example, to facilitate blinking and the like. It will be appreciated that the electroluminescent wire 40, 40*a* may be energized either as a self contained product with its controller 50 and excitation tucked into mask, attached to mask, safety helmet, or integrated (hard wired) preferably following already utilized electrical wire paths of full face mask electronic components, BAC—Breathing Apparatus Computer, power supply or the like. Controller 50 may also be configured as a remote package removably connected to the electroluminescent member 40, 40*a* in the mask 10. Electrical actuation switch 54 is configured to facilitate selection of the operation of the electroluminescent member 40. In one exemplary embodiment the electrical actuation switch 54 is configured as sliding or toggle switch with push-button to facilitate selection of mode of operation, for example, on/off with selection for emergency blinking of the electroluminescent member 40.

Turning now to FIG. 7, in another exemplary embodiment another control apparatus 60 is depicted. This control apparatus 60 is configured to operate inline with the electroluminescent member 40 and control apparatus 50 and includes a housing 62 and variable control 64 configured to facilitate variation of the operating parameters for the electroluminescent member 40 including, but not limited to, the illumination brightness and cycling frequency for emergency operation. Controller 60 may optionally include an optical sensor 66 to facilitate energizing the electroluminescent member 40, 40*a* automatically in low ambient light conditions. The optical sensor 66 may also be employed such that the brightness of the electroluminescent member 40 is adjusted, whether automatically or not, based on ambient light levels measured outside of the mask 10. Such an approach enhances glare control and/or energy consumption.

Turning now to FIG. 8, in another exemplary embodiment another control apparatus 70 is depicted, once again, configured to operate with the control apparatuses 50 and/or 60, and may further include a housing 72 with a cover 74 configured to contain an excitation source 76. In an exemplary embodiment the excitation source 76 is a battery, capacitor, and the like. The particular characteristics of excitation source are not particularly significant to the inventive concept as herein described and such may be adjusted to allow for a proper voltage eventually applied to the electroluminescent member 40, with the exception that excitation source 76 preferably be of such volume and weight that it not present an objectionable load to the wearer.

One of the desirable considerations for each control apparatus 50, 60, and 70 is that they be mounted or attached such that during operation the configuration permits a user to readily and conveniently don the mask 10 and be readily portable while also locating controls such as the actuation switch 54 and variable control 64 in a manner that they are readily accessible. Thus, control apparatus 50 and 60 at least, are preferably located with ready access e.g., within easy grasp and operation of the hands, while removably attached to the mask 10. In order to accomplish these objectives, in one exemplary embodiment, one or more of the control apparatuses 50, 60, and 70 may be located in a holder or pouch worn by the user or in a pocket of a garment or pack or vest. The access, portability, and removability of control apparatus 50, 60, and 70 is significant in that generally actuation may be accomplished while the mask 10 is worn by the user. A simple and quick method is preferably provided for access to and actuation of the controls such as the actuation switch 54 and variable control 64 due to the fact that actuation of such systems is generally under extremely hazardous conditions and removal of the mask 10 is undesirable. In yet another exemplary embodiment a pressure sensor 90 (see FIG. 11), or magnetic and/or commonly used on/off or safety button may be employed for actuation. For example, a pressure sensor or switch 90 switch may be optionally mounted on the mask's inner sealing member 14. When mask is donned, a pressure differential between users face and mask sealing member 14 may be employed to activate and deactivate the electroluminescent member 40

While for the purposes of illustration control apparatuses 50, 60, and 70 have been described as separate articles, it should be readily appreciated that they need not be. The functionality may be consolidated in one or more housings to facilitate any desired implementation. Moreover, while in an exemplary embodiment the control apparatuses 50, 60, and 70 respectively are depicted and hardwired with physical interfaces, it should be appreciated that such description should not be considered limiting. The interfaces could also be electronic, wired or wireless, optical and the like. Furthermore, the functionality described herein may readily be combined with any existing systems to facilitate integration and operation. For example, in another exemplary embodiment, a mask 10 also includes what is commonly referred to as a personal alert safety system 80 (PASS) (FIG. 1). The personal alert safety system 80 may be mounted on the body of the user or BAC—Breathing Apparatus Computer, power supply or the like. and provides an audio signal in the form of a beeping or other audio indication when the body of the user is motionless for some predetermined length of time. This type of system 80 has been used by firefighters and provides some measure of safety when a firefighter is hurt or otherwise immobilized for some predetermined time. However, the audio signal from a personal alert safety system 80 although having some effect, does not generally lead other firefighters and the like to the aid of an immobilized firefighter in a quick and efficient manner since it is a smoke filled environment where visual contact cannot be made.

Mask 10, lighting system 20, and the attendant control apparatuses 50, 60, and 70 for electroluminescent member 40 may be incorporated and coupled to personal alert safety system 80 in order to provide a blinking or strobing of electroluminescent member 40. As mentioned above, personal alert safety system 80 may include/employ a switch, e.g., similar to or integrated with switch 54 for coupling to the illumination system 20 when motion detection is not provided a pulsating signal may be supplied for blinking the electroluminescent member 40. In this manner, other users, e.g., firefighters will not only have an audio input as to the immobilized fireman but further will have a visual indication with observation into the mask as well as the light projected from the mask 10 of the immobilized fireman. The personal alert safety system 80 as herein described is commercially available from numerous manufacturers.

In yet another exemplary embodiment, the illumination system 20 may be readily integrated with a Heads Up Display (HUD) in the mask 10 as are commercially readily available. In mask applications particularly for rescuers, firefighters and the like, a HUD provides information pertaining to environmental parameters as well as status of selected systems including, but not limited to, a self contained breathing apparatus. Environmental parameters may include such information as temperature, air quality, position, orientation, and the like. Status information may include parameters such as remaining air in a storage tank. In an exemplary embodiment, the illumination system is preferably integrated with a HUD preferably to promote ease of operation and use without presenting additional burden and weight penalty to the user. For example, the HUD system and the illumination system 20 may be integrated into the mask 10 while preferably sharing wiring harnesses, one or more of the control apparatuses 50, 60, and 70, or even a common excitation source.

In yet another exemplary embodiment, the illumination system 20 may be readily integrated with a voice amplification system with the mask 10 as are commercially available. In mask applications particularly for rescuers, firefighters and the like, a voice amplification system provides amplification of a users voice to enable clear communications. For example, the voice amplification system and the illumination system 20 may be integrated into the mask 10 while preferably sharing wiring harnesses, one or more of the control apparatuses 50, 60, and 70, or even a common excitation source. In an exemplary embodiment, the illumination system may vary the color, brightness, blinking rate, and the like, of the illumination to provide an indication of which user is speaking.

Still further, electroluminescent member 40 provides additional advantages in that a variety of colors may be provided for each electroluminescent member 40. The particular color may be determined by the particular phosphor type which includes a number of colors including, but not limited to, blue, green and yellow. Electroluminescent member 40 further allows for differing colors by blending of multiple phosphors or adding fluorescent dyes to the phosphor layer. The use of different colors for individual masks 10 is highly beneficial by facilitating an additional level of distinction among individual users. For example, coordination of rescue teams, buddies, or a firefighter's color may designate the command chain. In hazardous environments it is often critical that firefighters are able to detect, appreciate, and carry out orders from those in command.

Figure 9:
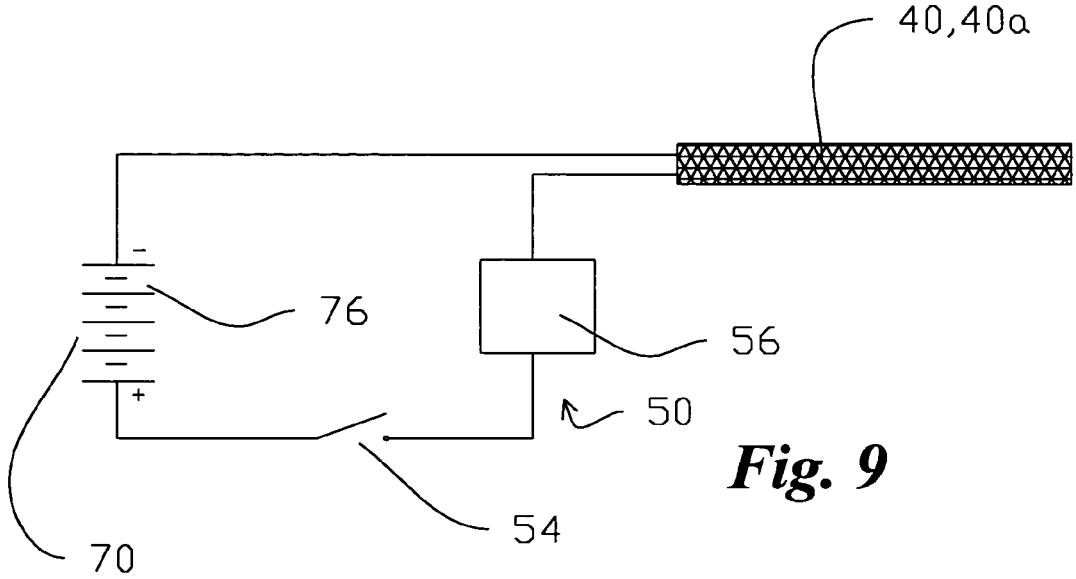
FIG. 9 depicts a basic schematic diagram for operation of the exemplary embodiments.
Figure 10:
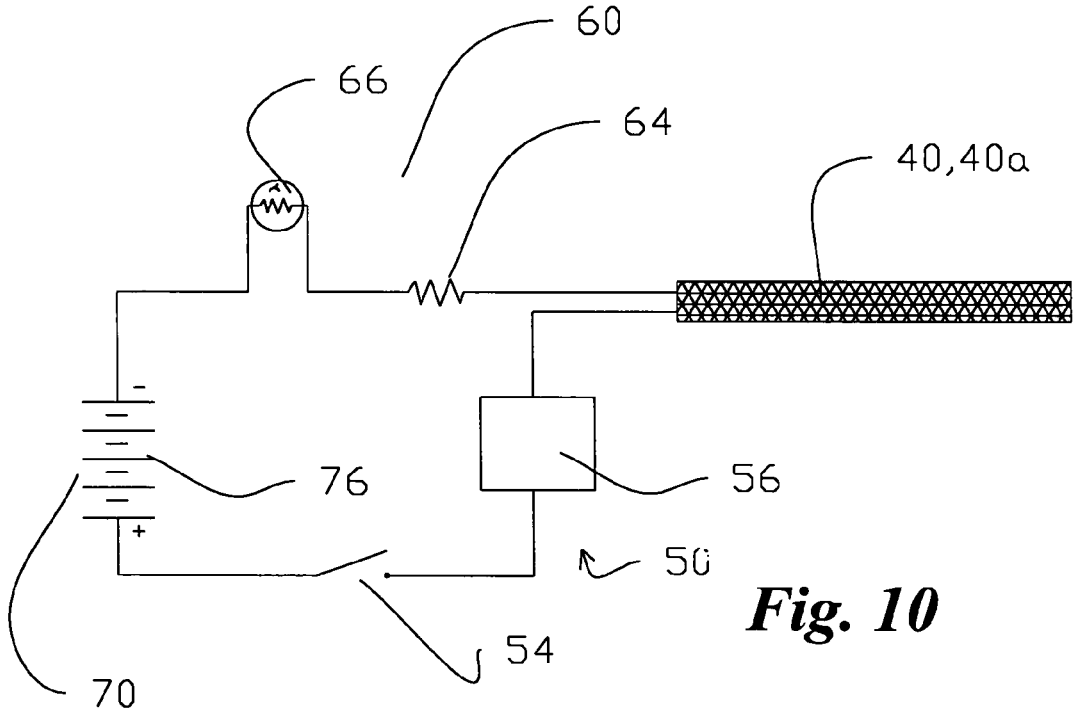
FIG. 10 depicts another basic schematic diagram for operation of the exemplary embodiments.

Turning now to FIGS. 9 and 10 depicting schematics of various implementations of the exemplary embodiments, FIG. 9 depicts a basic schematic diagram for operation of the disclosed embodiment. In an exemplary embodiment, the circuit includes control apparatuses 50 and 70 including an actuation switch 54 and excitation source 74, e.g., a battery in a circuit with the electroluminescent member 40, 40*a*. Further, the circuit may optionally include a transformer or timer 56 to facilitate implementation of on/off functions and blinking modes. FIG. 10 depicts further optional expansions of the functionality provided by the circuit of FIG. 9 by adding control apparatus 60 with a variable control 62 and even an optical sensor 64 to enable the circuit automatically in darkness.

Figure 11:
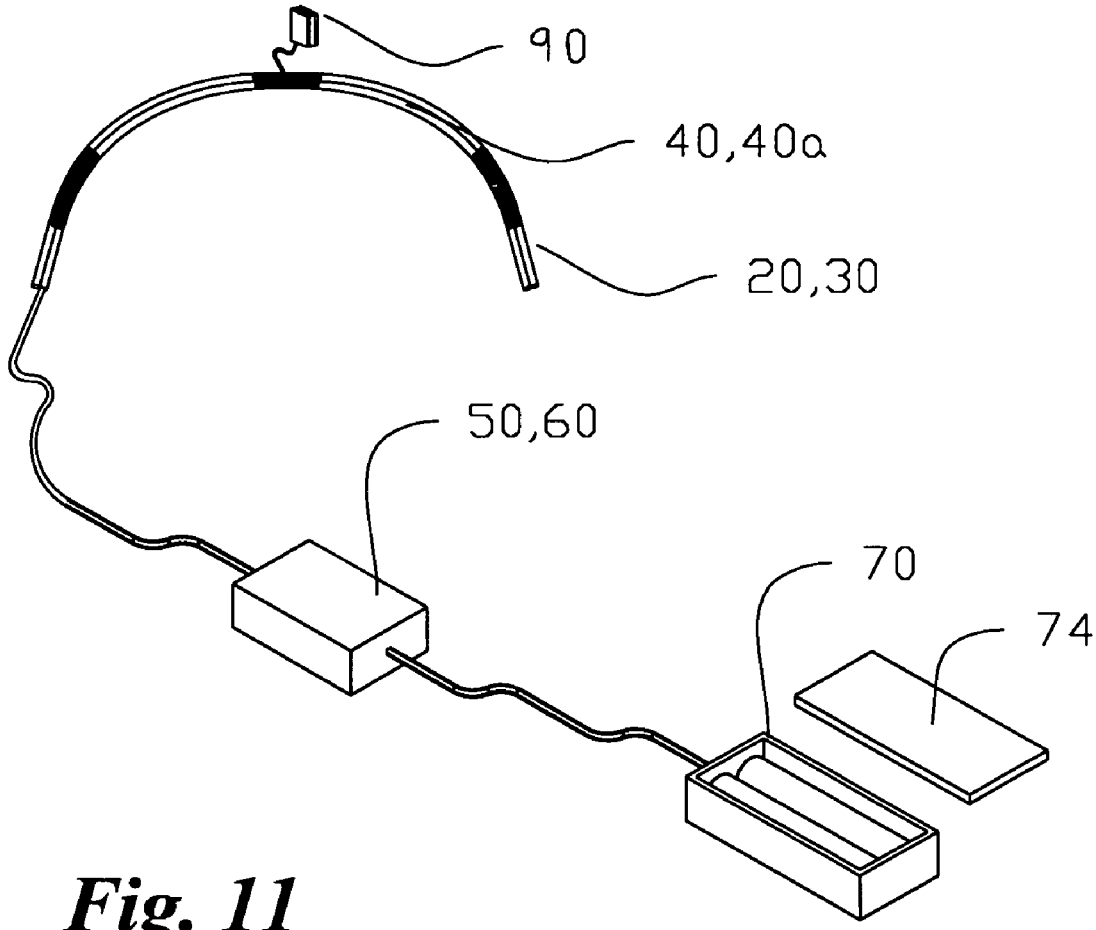
FIG. 11 depicts an interconnection of the apparatus in accordance with an exemplary embodiment.

FIG. 11 depicts an exemplary implementation depicting the illumination system 20 with support member 30 and the electroluminescent member 40, 40*a* interconnected with the control apparatuses 50 and 70.

It will be appreciated that the use of "first" and "second" or other similar nomenclature for denoting similar items is not intended to specify or imply any particular order unless otherwise specifically stated. Likewise the use of "a" or "an" or other similar nomenclature is intended to mean "one or more", unless otherwise specifically stated.

While the invention has been described with reference to an exemplary embodiment thereof, it will be understood by those skilled in the art that the present disclosure is not limited to such exemplary embodiments and that various changes may be made and equivalents may be substituted for elements thereof without departing from the scope of the invention. In addition, a variety of modifications, enhancements, and/or variations may be made to adapt a particular situation or material to the teachings of the invention without departing from the essential spirit or scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A face mask having an illumination system, the face mask comprising:

a face mask having a face shield, a portion of which is visible therethrough, the face mask substantially preventing fluid communication from an external environment to the interior of the mask when worn by a user; and an illumination system disposed within the interior of the face mask such that the illumination system is visible through the face shield portion, illuminates the face of the user and projects light outward through the face shield of the face mask simultaneously.

2. The face mask of claim 1, further comprising a support structure attached to the mask to support the illumination system.

3. The face mask of claim 2, wherein the support structure includes an eyewear insert.

4. The face mask of claim 2, wherein the support structure is attached to the face mask with at least one of clips, adhesive, wire, shrink tubing, epoxy or molded in the mask.

5. The face mask of claim 4, wherein the shrink tubing is at least one of luminescent or reflective.

6. The face mask of claim 2, wherein the support structure is removably attached to the mask.

7. The face mask of claim 1, further comprising a sealing member to substantially prevent fluid communication between the external environment and the interior of the mask when worn by the user.

8. The face mask of claim 1, further comprising a breathing apparatus operably connected to the face mask.

9. The face mask of claim 1, wherein the illumination system comprises at least one of a luminescent, fluorescent, incandescent, a light emitting diode or reflective member.

10. The face mask of claim 1, wherein the illumination system comprises an electroluminescent member.

11. The face mask of claim 10, wherein the electroluminescent member is at least one of an electroluminescent wire or strip.

12. The face mask of claim 10, wherein the excitation source is a DC voltage or AC voltage to facilitate blinking of the illumination system.

13. The face mask of claim 1, further comprising a first control apparatus to control the power supply to the illumination system.

14. The face mask of claim 13, further comprising a second control apparatus operably connected to the first control apparatus, the second control apparatus controlling selection of at least one of an operating mode or parameter for the illumination system.

15. The face mask of claim 14, further comprising a third control apparatus operably connected to at least one of the first control apparatus or the second control apparatus, the third control apparatus controlling the level of excitation provided to the illumination system.

16. The face mask of claim 14, wherein an operating mode is at least one of on/off or emergency blinking and a parameter is at least one of brightness and blinking speed.

17. The face mask of claim 1, wherein the illumination system provides at least one of:

(i) a blinking function, (ii) multiple color illumination, (iii) integration with a personal alarm safety system, (iv) integration with a voice amplification system, or (v) integration with Heads Up Display system.

18. The face mask of claim 17, wherein the integration with a personal alarm safety system includes at least one of shared excitation, shared controls, shared interfaces and harnesses, or commonly initiated blinking and audible warning.

19. The face mask of claim 17, wherein the integration with a Heads Up Display system includes at least one of shared excitation, shared controls, shared interfaces and harnesses, and shared displayed information.

* * * * *